US005934793A

United States Patent [19]

Rahman

[11] Patent Number: 5,934,793

[45] Date of Patent: Aug. 10, 1999

[54] NET LIGHTS

[75] Inventor: Najeh Rahman, Monsey, N.Y.

[73] Assignee: Minami International Corp., Yonkers, N.Y.

[21] Appl. No.: 08/988,489

[22] Filed: Dec. 10, 1997

[51] Int. Cl.[6] ..... F21V 21/00

[52] U.S. Cl. ..... 362/249; 362/123; 362/806

[58] Field of Search ..... 362/123, 252, 362/806, 234, 249, 11

[56] References Cited

U.S. PATENT DOCUMENTS

| | | | |
|---|---|---|---|
| 1,974,472 | 9/1934 | Seghers | 362/236 |
| 3,096,943 | 7/1963 | Forrer | 362/237 |
| 3,714,414 | 1/1973 | Sternius | 362/238 |
| 3,755,663 | 8/1973 | George, Jr. | 362/236 |
| 4,228,486 | 10/1980 | Matsuya | 362/237 |
| 4,720,773 | 1/1988 | Ahroni | 362/236 |
| 4,870,547 | 9/1989 | Crucefix | 362/237 |
| 4,994,944 | 2/1991 | Vernöndier | 362/238 |
| 5,057,976 | 10/1991 | DuMong | 362/236 |
| 5,213,519 | 5/1993 | Dorfman | 362/123 |
| 5,424,925 | 6/1995 | Jenke et al. | 362/236 |
| 5,526,248 | 6/1996 | Liou | 362/123 |
| 5,601,361 | 2/1997 | Lawrence | 362/236 |
| 5,632,550 | 5/1997 | Yeh | 362/237 |
| 5,645,342 | 7/1997 | Chang | 362/236 |
| 5,662,409 | 9/1997 | Huang | 362/238 |
| 5,667,295 | 9/1997 | Tsui | 362/252 |
| 5,669,707 | 9/1997 | Huang | 362/236 |
| 5,700,081 | 12/1997 | Mengle et al. | 362/236 |

*Primary Examiner*—Sandra O'Shea
*Assistant Examiner*—Marshall Honeyman
*Attorney, Agent, or Firm*—Amster, Rothstein & Ebenstein

[57] ABSTRACT

A net light includes at least one light string, each light string defining intermediate portions and including a plurality of lamp sockets and a plurality of electrical wires. Fasteners are provided for connecting an adjacent pair of the intermediate portions together intermediate an adjacent pair of lamps sockets in each light string. The plurality of wires in each light string is twisted together intermediate the lamp sockets thereof; and the plurality of wires in each light string, except for one wire of each light string, is twisted together adjacent to the lamp sockets thereof. The one wire of each light string is in electrical communication with the plurality of lamp sockets in the light string.

12 Claims, 5 Drawing Sheets

FIG. 2
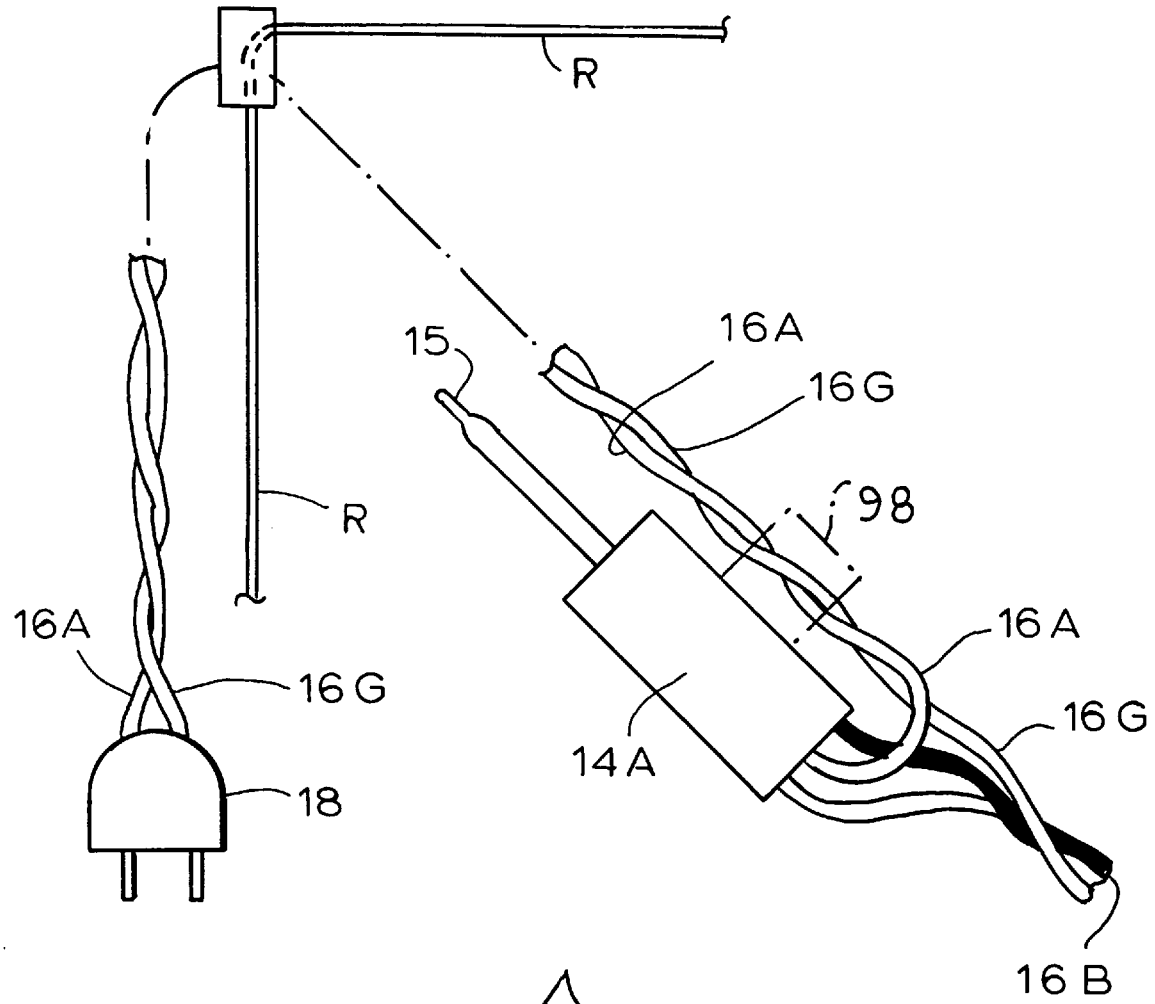
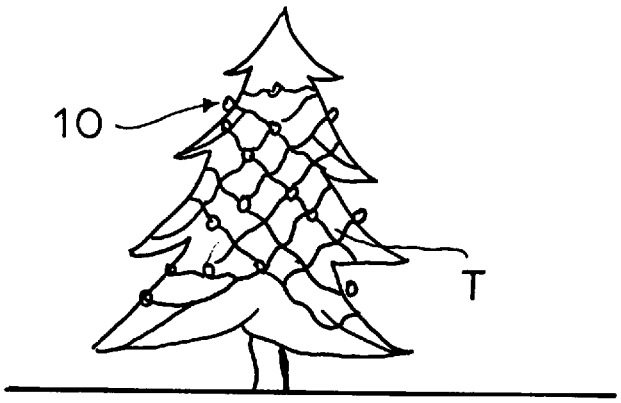
FIG. 4

NET LIGHTS

BACKGROUND OF THE INVENTION

The present invention relates to a net light, and more particularly to an improved net light which does not require special means to keep the plurality of wires in a light string together for movement as a unit.

One type of net light is composed of a plurality of light strings, each light string defining intermediate portions which have been or may be physically joined together at various points by fasteners in order to collectively form a net light. Each light string is in turn composed of a plurality of lamp sockets and at least two, and often three, electrical wires. The light string defines intermediate portions between adjacent pairs of lamp sockets, and a plurality of fasteners physically connect intermediate portions of adjacent pairs of light strings (one intermediate portion of one light string and one intermediate portion of another light string) together at various points along their respective lengths in order to form a portion of the net light.

Another type of net light is composed of but a single light string defining intermediate portions which have been or may be physically joined together at various points by fasteners in order to collectively form a net light. Again, the light string is in turn composed of a plurality of lamp sockets and at least two, and often three, electrical wires. The light string defines intermediate portions between adjacent pairs of lamp sockets, and a plurality of fasteners physically connect pairs of intermediate portions (of the single light string) together in order to form a portion of the net light.

Typically, one wire of each light string is in both physical and electrical communication with a power supply and with the plurality of lamp sockets of the light string, typically in and adjacent to the lamp sockets. This is referred to herein as the "active" wire. Another wire is in electrical communication with the power supply from the last of the lamp sockets and completes the circuit of the light string with the power supply. This is referred to herein as the "ground" or "return" wire. Typically, where the light strings are to be joined in series, there is also a wire which functionally extends from the first lamp socket of a first light string to the first lamp socket of the next light string (e.g., via the receptacle end of the first light string), but is not in direct electrical communication with any of the other lamp sockets of the first light string. This is referred to herein as the "bypass" wire as it carries the voltage from the power supply to the first light socket in the next light string, bypassing all of the lamps of the light string.

As only the active wire is necessarily in physical contact with each lamp socket of a light string, some means must be provided for maintaining it together with the return ground wire or return and bypass wires associated with the active wire so as to present an aesthetically appealing net-like appearance both at and between the lamp sockets. The known net lights have not proven to be entirely satisfactory in use in this respect because of messiness and untidiness problems associated with the light string portions which are connected by the fasteners. This problem has been addressed in various ways. For example, each lamp socket has been formed with an extension (or two extensions) which releasably grasps the return wire (or return and bypass wires) and maintains it (or them) closely proximate to the lamp socket for movement as a unit. One obvious technique involves the use of an auxiliary fastener or socket extension disposed on one side of the lamp socket (or two auxiliary fasteners disposed on opposite sides of the lamp socket) for maintaining the various electrical wires as a unit on the lamp socket, the active wire entering and leaving the lamp socket and the return wire (or return and bypass wires) being held by the auxiliary fastener(s). This technique adds substantially to the cost of manufacture of the light strings due to the additional material costs of the auxiliary fastener(s) and the need for additional manufacturing steps to insert the wires into the auxiliary fastener(s) of each lamp socket. Further, as the auxiliary fastener(s) increases the effective diameter of the lamp socket, it reduces the aesthetic appeal of the lamp string. Finally, this technique fails to keep the wires together intermediate the lamp sockets.

As another example, each lamp socket has been provided with a heat-shrunk sleeve which maintains the return wire (or return and bypass wires), as well as the active wire, closely proximate to the lamp socket. This technique also adds substantial costs to manufacture of a light string due to the additional material costs of the sleeve and the need for additional manufacturing steps to heat-shrink the sleeve about the lamp socket and wires. Finally, this technique fails to keep the wires together intermediate the lamp sockets.

Since the net light of the present invention is ideally suited to being draped over a bush, Christmas tree or similar object, it is also desirable to orient the axis of each light socket to be parallel to at least the active wire. In such instance the lamp remains visible. If the lamp socket is not oriented in such manner, many of the lamps will extend into the bush, tree or other object, and the light from the lamps will therefore be blocked.

Accordingly, it is an object of the present invention to provide a net light composed of at least one light string defining intermediate portions and fasteners for connecting an adjacent pair of the intermediate portions together, preferably without any auxiliary fasteners or sleeves to maintain the various wires of a light string neatly together in the form of a net or grid.

Another object is to provide such a net light wherein the plurality of wires in a given light string is maintained together for movement as a unit.

A further object of a preferred embodiment of this invention is to provide means to orient the axis of each lamp socket relative to the axis of the active wire to enhance the visual impact of the net light when installed over a bush, tree or other object.

SUMMARY OF THE INVENTION

It has now been found that the above and related objects of the present invention are obtained by a net light comprising: (A) at least one light string, each light string including a plurality of lamp sockets and a plurality of electrical wires and defining intermediate portions between adjacent pairs of the lamp sockets, and (B) fastener means for connecting a pair of the intermediate portions together (intermediate an adjacent pair of the lamp sockets in each light string containing the intermediate portion). According to the present invention, the plurality of wires in each light string is twisted together at least intermediate the lamp sockets of the light string, and the plurality of the wires in each light string, except for one wire of each light string, is twisted together adjacent the lamp sockets of the light string. The one wire of each light string is in electrical communication with the plurality of lamp sockets of the light string adjacent to the lamp sockets.

Preferably, the wires are twisted together for movement as a unit. Also, the one wire is in electrical communication with each of the plurality of lamp sockets of the light string adjacent to each lamp socket thereof.

In one preferred embodiment, the net light comprises a plurality of light strings, each light string including a plurality of lamp sockets and a plurality of electrical wires, and fastener means for connecting an adjacent pair of the light strings together intermediate an adjacent pair of the lamps sockets in each light string of the adjacent pair. The plurality of wires in each light string is twisted together for movement as a unit intermediate the lamp sockets of the light string. The plurality of wires in each light string, except for one wire of each light string, is twisted together for movement as a unit adjacent to the lamp sockets of the light string. The one wire of each light string is in electrical communication with each of the plurality of lamp sockets of the light string adjacent to each lamp socket thereof.

In another preferred embodiment, the net light comprises a single light string, the light string including a plurality of lamp sockets and a plurality of electrical wires and defining intermediate portions between adjacent pairs of lamp sockets, and fastener means for connecting a pair of the intermediate portions together intermediate adjacent pairs of lamp sockets. The plurality of wires in the light string is twisted together for movement as a unit intermediate the lamp sockets of the light string. The plurality of wires in the light string, except for one wire of the light string, is twisted together for movement as a unit adjacent to the lamp sockets of the light string. The one wire of the light string is in electrical communication with each of the plurality of lamp sockets of the light string adjacent to each lamp socket thereof.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 2 is a fragmentary front elevational view, to a greatly enlarged scale, of an intermediate portion and a plug and of the net light;

FIG. 4 is a front elevational view of the net light as disposed on a Christmas tree;

FIGS. 2 and 3 are shaded for contrast, and not for color, for pedagogic purposes only.

DETAILED DESCRIPTION OF THE PREFERRED EMBODIMENTS

Figure 1:
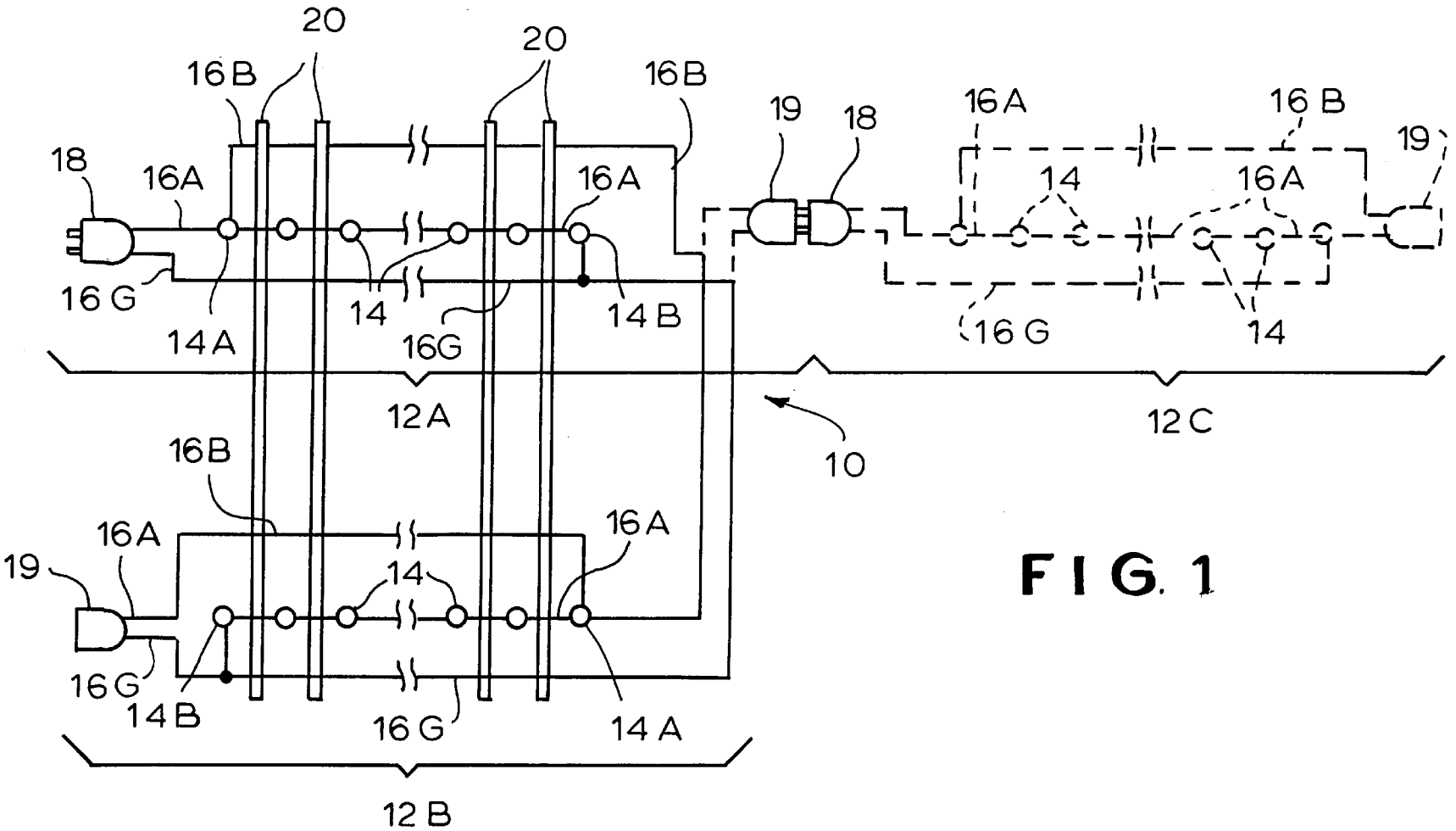
FIG. 1 is a front elevational view of a first embodiment of an extended net light according to the present invention.

Referring now to the drawing, and in particular to FIG. 1 thereof, therein illustrated is a first embodiment of a net light according to the present invention, generally designated by the reference numeral 10. The net 10 is comprised of a plurality of light strings, generally designated 12, effectively disposed in parallel. Each light string 12A, 12B, etc., in turn includes a plurality of lamp sockets 14 and a plurality of electrical wires 16. Each lamp socket 14 receives a miniature lamp 15 .

Where one light string 12 is intended to be placed in parallel with another light string 12 (e.g., to form a 100 lamp net light from two 50 lamp net lights), as illustrated in FIG. 1, there will typically be three electrical wires: an "active" wire 16A which is in physical communication with (i.e., physically passes into and out of the interior of) each of the lamp sockets 14 and is in electrical communication therewith to provide electrical power to the lamps 15 from a power supply, a "ground" or "return" wire 16G which provides a return of electrical power to the power supply, but is preferably not in electrical communication with any of the lamp sockets 14, or in physical communication with any of the lamp sockets 14 except the last lamp socket 14B, and a "bypass" or "full voltage" wire 16B (indicated by dark shading in FIGS. 2 and 3) which is preferably not in either physical or electrical communication with any intermediate lamp sockets 14 but carries the initial voltage differential of the plug end 18 of the light string 12 (i.e., active wire 16A relative to return wire 16G) over to the receptacle end 19 of the light string 12 so that the full initial differential voltage is applied at the beginning of each light string physically connected in series. More particularly, for both safety and aesthetic reasons, it is preferred that the plug end of the bypass wire 16B be in electrical communication with the active wire 16A within the first lamp socket 14A (see FIG. 2) so that it receives the full initial voltage differential, and that the receptacle end of the bypass wire 16B be in electrical communication with the active wire 16A of the next light string 12 after the last lamp socket 14B of the first light string (see FIG. 3) or within the receptacle end 14B itself so that the emerging active wire 16A applies the full initial voltage differential at the receptacle end 19 of the first light string 12. Where a light string 12 is not intended to be electrically connected (either in series or in parallel) with another light string, the bypass wire 16B may be deleted so that there are only two electrical wires 16A, 16G in the light string.

The net light 10 additionally includes fasteners, generally designated 20, for physically (but not electrically) connecting an adjacent pair of light strings 12A, 12B together. Each fastener 20 physically connects the wires 16 intermediate an adjacent pair of the lamp sockets 14 (i.e., the intermediate portions) in one of an adjacent pair of light strings 12A, 12B to the like wires 16 of the other of the adjacent pair 12B, 12A. The fasteners 20 may maintain adjacent pairs of light strings together in any of a variety of different patterns (e.g., as illustrated, a pair of parallel light strings).

The fastener 20 physically interconnects the adjacent pair of light strings 12, but does not put them in electrical communication. Preferably the fastener 20 is formed of an electrically insulative, flexible material and is configured and dimensioned to minimize physical wear of the wires 16 of the adjacent light strings 12 connected thereby. While the fasteners 20 are illustrated as connecting together only an adjacent pair of light strings 12, clearly such fasteners 20 may be used to connect more than one adjacent pair of light strings 12 together; in other words, each fastener 20 may connect three or more adjacent light strings 12 together. Each fastener 20 may be formed by an elongate strip of insulative plastic which is wrapped around the wires 16 of at least two light strings 12, with the fastener ends being joined together, for example, by a gripping head at one fastener end.

As illustrated in FIG. 1, the light string 12A may be connected to another light string 12B (shown in solid line) or 12C (shown in phantom line). The connection of light strings 12A and 12C is by means of a receptacle end 19 of light string 12A and a plug end 18 of light string 12C. The connection of light strings 12A and 12B is a hard-wire functional equivalent of the 12A/12C receptacle/plug connection.

Figure 3:
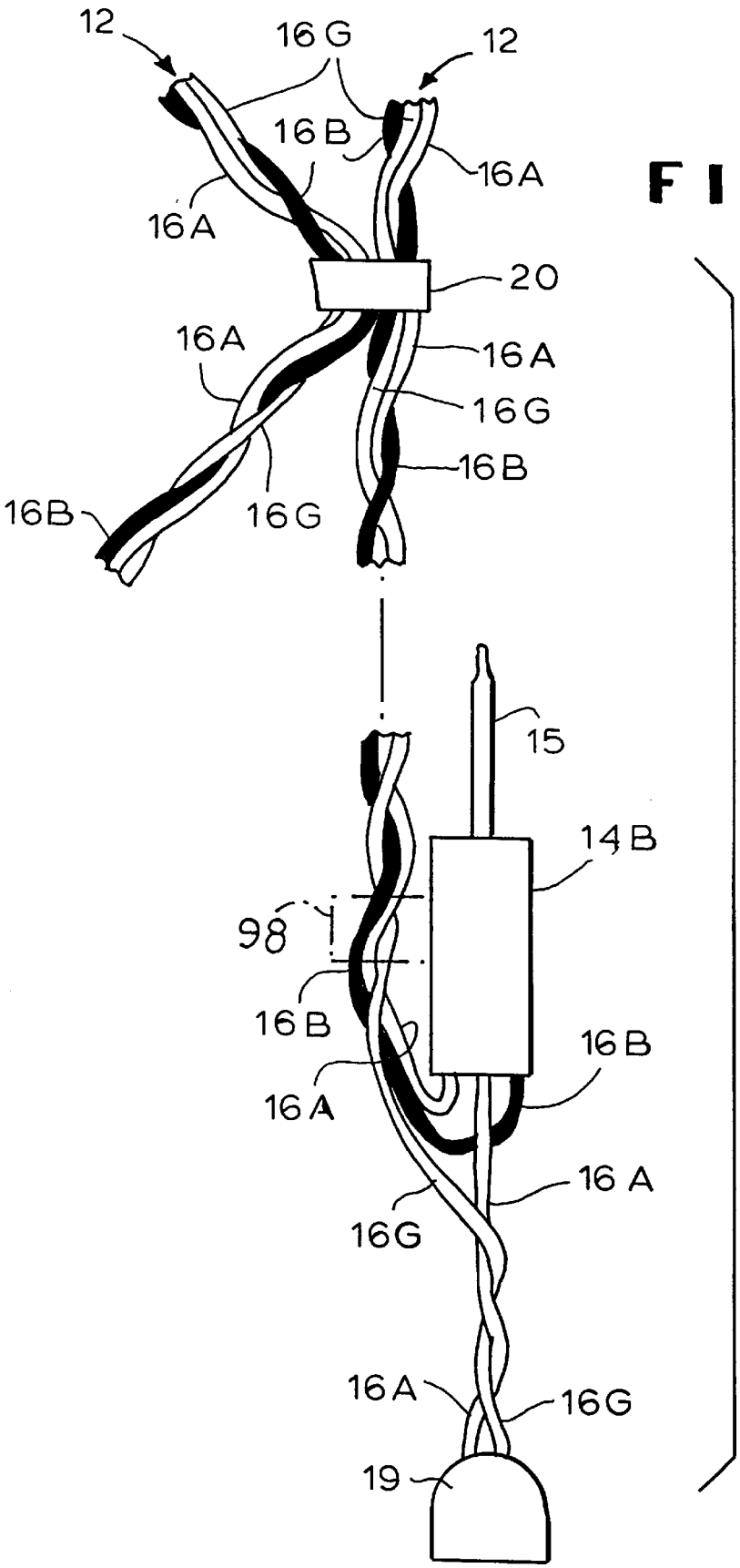
FIG. 3 is a fragmentary front elevational view, to a greatly enlarged scale, of an intermediate portion and a receptacle end of the net light.
Figure 5:
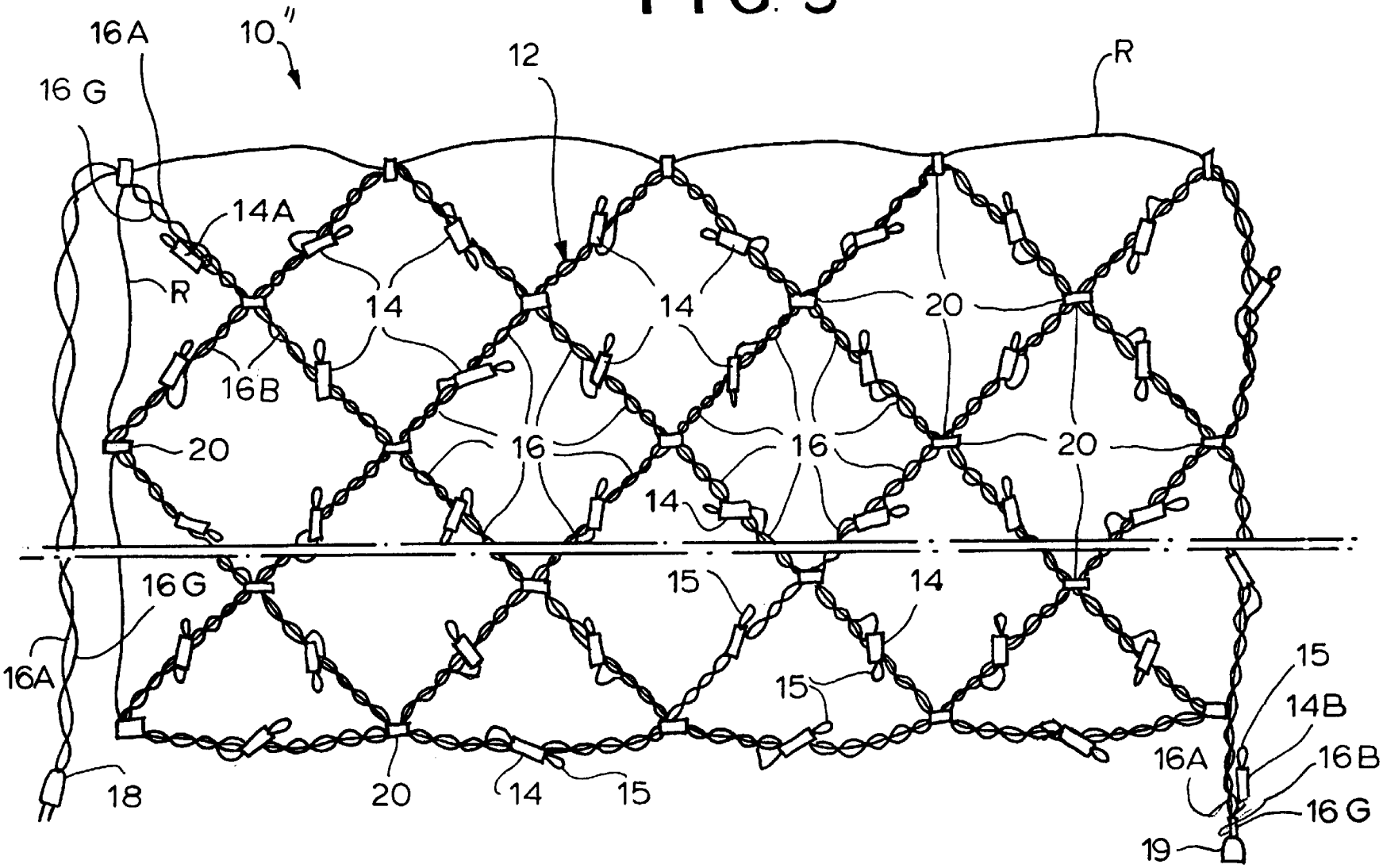
FIG. 5 is a fragmentary front elevational view of a second embodiment of an extended net light according to the present invention.

While FIG. 1 illustrates a first embodiment 10 of a net light composed of at least two light strings 12 with the light strings 12 being secured or securable together by fasteners 20 (as illustrated in FIG. 3), FIG. 5 illustrates a second or alternative embodiment 10' of the present invention wherein the net light is composed of but a single light string 12 and fasteners 20. The light string 12 is in turn composed of a plurality of lamp sockets 14 and at least two, and often three, electrical wires. Fasteners 20 physically connect together adjacent pairs of intermediate portions in order to form a portion of the net light 10'. In this instance, intermediate portions of the light string 12 (that is, the portions intermediate adjacent pairs of the lamp sockets 14) are physically connected by the fasteners 20. The single light string 12 may be configured so that the various intermediate portions thereof are joined or joinable together by the fasteners 20 (intermediate adjacent pairs of lamp sockets) at various points in order to collectively form one of various possible net light patterns (a parallel pair of light strings illustrated).

In the second or alternative embodiment 10' of the net light, there is an active wire 16A and a ground wire 16G, and, when another net light may be added thereto, a bypass wire 16B as well. Typically, there are about fifty lamp sockets per light string 12 so as to accommodate a 120 volt differential between the return and active wires 16G and 16A, with about 2½ volt lamps being used. Each light set is composed of a plurality of lamp sockets 14 and at least two electrical wires 16G and 16A, a third electrical wire 16B being present when another net light will be connected thereto. The bypass wire 16B extends from the first lamp socket 16A to the receptacle end 19 (beyond the last lamp socket 16B), bypassing all of the lights 15, so as to maintain an appropriate voltage differential at the receptacle end 19 of the net light equal to that at the plug end 18 thereof. Each light string 12 is thus, in effect, in parallel electrical communication.

As will be apparent to those skilled in the art, the principles of the present invention are equally applicable to net lights having a plurality of light strings 12 or only a single light string 12.

As net lights of the type described herein above are well known in the art, it is not deemed necessary to provide further details thereof herein. While the active wire 16A, return wire 16G and bypass wire 16B are each shown separately (that is, not twisted together) in each light string 12A, 12B, 12C for pedagogic purposes, portions of at least two of them are in fact twisted together intermediate the plug 18 and the lamp socket 14A, intermediate the lamp sockets 14 and intermediate the lamp socket 14B and the receptacle 19, as illustrated in FIGS. 2 and 3.

Regardless of whether the plurality of wires 16 in each light string 12 is two (i.e., 16A and 16G), three (i.e., 16A, 16B and 16G), or more, in each light string 12 the full plurality of wires 16 is twisted together intermediate adjacent pairs of the lamp sockets 14 of each light string 12. The plurality of wires 16 is twisted as a unit such that the several wires hold together for movement as a unit under normal conditions of use. Thus, as best illustrated in FIGS. 2 and 3, the plurality of wires 16A, 16B and 16G in the light string 12 are twisted together intermediate the adjacent pairs of lamp sockets 14 of the light strings 12 (and more particularly intermediate the first and last lamp sockets 14A and 14B thereof). The most effective number of twists intermediate an adjacent pair of lamp sockets 14 on a given light string 12 will depend upon the electrical wires being used (e.g., the number of wires, the thickness of the wires and the type of insulation), the length of the wires intermediate the adjacent lamp sockets 14, etc. Preferably a full turn every two inches is sufficient for the purposes of the present invention.

The plurality of wires 16A, 16B, 16G in each light string 12, with the exception of one wire 16B of each light string 12, is twisted together adjacent to the lamp sockets 14 of the light string 12. Thus, the return and bypass wires 16G and 16B in the light string 12 are twisted together (without active wire 16A) adjacent to the lamp sockets 14 thereof. On the other hand, the one wire (i.e., the active wire 16A) is in electrical communication with each of the plurality of lamp sockets 14 of that light string 12 in or adjacent to the lamp sockets 14. Thus, the active wire 16A of each light string 12 separates (i.e., is untwisted) from the other wires 16B, 16G in that light string 12 proximately before each lamp socket 14 of that light string (starting with lamp socket 14A), passes into and out of each lamp socket 14 of that light string 12 (adjacent to the lamp sockets 14) in a conventional manner, and returns to be twisted with the other wires 16B, 16G proximately after each light socket 14 of that light string 12 (ending with lamp socket 14B). Accordingly, the lamp sockets 14 in a light string 12 are physically and electrically connected in series by the one wire 16A. Preferably the one wire 16A is in electrical communication with each of the plurality of the lamp sockets 14 of the light string 12 adjacent to each lamp socket 14 thereof.

The twisting together of the several wires 16 obviates the need for a special lamp socket equipped with an auxiliary fastener or sleeve to receive and maintain the wires 16B, 16G in proximity to the lamp socket, thereby reducing the cost of manufacture of the lamp sockets. Twisting of the wires (either all the wires or all the wires except for the active one wire 16A) may be inexpensively and easily produced without the costs associated with specialized lamp sockets having extensions, auxiliary fasteners or sleeves. The resultant net light is aesthetically appealing, as all of the wires of the light string are maintained together for movement as a unit, except for the active wire, which is only slightly separated from the other wires in the region of each lamp socket.

For particular applications, the lamp sockets 14 may be provided with an auxiliary fastener or sleeve (not shown) to assist in orienting the axis of the lamp socket generally parallel to the wires 16 and in maintaining the twisted wires 16B, 16G neatly associated with the lamp socket 14 and active wire 16A without blocking viewing of the lamp 15.

In order to provide more substantial support for the net and enable it to be more easily stretched out over a bushy Christmas tree or the like (as illustrated in FIG. 4), the net light may be provided with a rope R which defines at least a portion of the periphery of the extended net (FIG. 1 showing the rope R at the top and one side of the light net 10) intermediate the plug and receptacle ends 18 and 19 to facilitate grasping of the net light.

Figure 6:
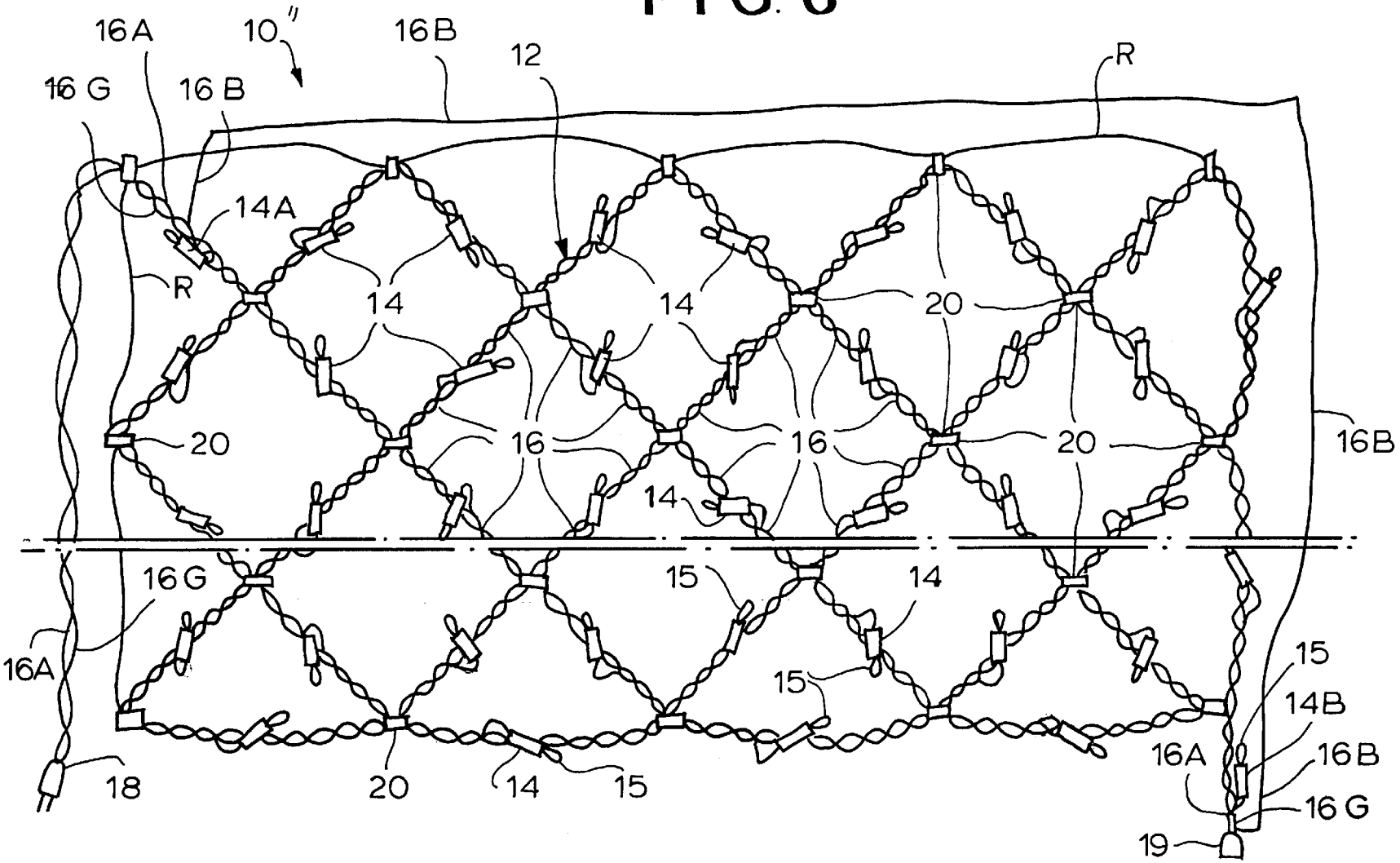
FIG. 6 is a fragmentary front elevational view of a variant of the second embodiment.

Referring now to FIG. 6, therein illustrated is a variant 10" of the second embodiment of a net light 10. In this variant the bypass wire 16B extends directly from the plug end 18 (or the first lamp socket 14A) to the receptacle end 19. Accordingly, in this instance the bypass wire 16B is not considered part of the plurality of wires in the light string as it does not follow the contours of the light string, but rather takes a short cut between the plug and receptacle ends 18, 19, thereby greatly reducing a major cost of a net light—namely, the wiring.

Whereas FIG. 5 illustrates the bypass wire 16B passing closely adjacent each of the individual light sockets 14 of the light string 12, and being intertwined with both of the other wires 16A and 16G intermediate the first lamp socket 14A and the last lamp socket 14B, this represents an unnecessary use of wire, one of the most costly elements in the net light. Accordingly, FIG. 6, otherwise similar to FIG. 5, illustrates a variant 10" characterized by a direct connection of the bypass wire 16B from the first socket 14A (functionally proximate to the plug end 18) directly to the receptacle end. It will be apparent to those skilled in the art that the amount of bypass wire thus saved is substantial. In this case, of course, the bypass wire 16B would not be considered one of the plurality of wires forming the light string 12.

In the variant 10", the bypass wire 16B may be secured to the remainder of the net light or to the rope R by various peripheral connectors (not shown) so as to maintain the bypass wire 16B closely adjacent the periphery of the net light 10". Indeed, as the object is to save on the length of the bypass wire 16B, the bypass wire may follow the shortest possible path between the first lamp socket 14A and the receptacle end 19. In a light net composed of multiple light strings 12, the bypass wire 16B need only be in connection with the first lamp socket of each lamp string (typically lamp number 1, lamp number 51, etc.) and the final receptacle end 19. In fact, a combination of various configurations for the bypass wire 16B is possible with the proviso that each configuration put the bypass wire 16B functionally in electrical communication with the first lamp socket 14A of each light string 12.

To summarize, the present invention provides a net light which maintains the several electrical wires of each light string together for movement as a unit, preferably without the use of any auxiliary fastener or sleeve.

Now that the present invention has been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. In a net light comprising:

(A) at least one light string, each said light string including a plurality of lamp sockets and a plurality of electrical wires and defining intermediate portions intermediate adjacent pairs of said lamp sockets; and (B) fastener means for connecting a pair of said intermediate portions together intermediate adjacent pairs of said lamp sockets;

the improvement comprising:

(i) said plurality of wires in each said light string being twisted together intermediate said lamp sockets of said light string;

(ii) said plurality of wires in each said light string, except for one wire of each said light string, being twisted together adjacent to said lamp sockets of said light string; and (iii) said one wire of each said light string being in electrical communication with each of said plurality of lamp sockets of said light string adjacent to each of said lamp sockets without electrically contacting any lamp sockets of any other light string.

2. The net light of claim 1 wherein said wires are twisted together for movement as a unit.

3. In a net light comprising:

(A) a plurality of light strings, each light string including a plurality of lamp sockets and a plurality of electrical wires; and (B) fastener means for connecting an adjacent pair of said light strings together intermediate an adjacent pair of said lamp sockets in each light string;

the improvement comprising:

(i) said plurality of wires in each said light string being twisted together for movement as a unit intermediate said lamp sockets of said light string;

(ii) said plurality of wires in each said light string, except for one wire of each said light string, being twisted together for movement as a unit adjacent to said lamp sockets of said light string; and (iii) said one wire of each said light string being in electrical communication with each of said plurality of lamp sockets of said light string adjacent to each said lamp socket thereof without electrically contacting any lamp sockets of another light string.

4. In a net light comprising:

(A) a single light string, said light string including a plurality of lamp sockets and a plurality of electrical wires and defining intermediate portions intermediate adjacent pairs of said lamp sockets; and (B) fastener means for connecting a pair of said intermediate portions together intermediate adjacent pairs of said lamp sockets;

the improvement comprising:

(i) said plurality of wires in said light string being twisted together for movement as a unit intermediate said lamp sockets of said light string;

(ii) said plurality of wires in said light string, except for one wire of said light string, being twisted together for movement as a unit adjacent to said lamp sockets of said light string; and (iii) said one wire of said light string being in electrical communication with each of said plurality of lamp sockets of said light string adjacent to each said lamp socket thereof and spaced from said fastener means.

5. In a net light comprising:

(A) at least two light strings, each said light string including a plurality of lamp sockets and at least two electrical wires and defining intermediate portions intermediate adjacent pairs of said lamp sockets; one wire of a pair of said at least two wires of each said light string being in electrical communication with said plurality of lamp sockets of said light string adjacent to said lamp sockets; and (B) fastener means for connecting a pair of said intermediate portions together intermediate adjacent pairs of said lamp sockets;

the improvement comprising:

(i) said pair of wires in each said light string being twisted together intermediate said lamp sockets of said light string; and (ii) a third wire in one of said light strings being a bypass wire extending directly from, and being in electrical communication with, the first of said plurality of lamp sockets of said light string and the first of said plurality of lamp sockets of an adjacent next light string without physically or electrically contacting any other lamp sockets of said light string.

6. The net light of claim 5 wherein said pair of wires are twisted together for movement as a unit.

7. The net light of claim 5 wherein said one wire is in electrical communication with each of said plurality of lamp sockets of said light string adjacent to each said lamp socket thereof.

8. In a net light comprising:

(A) a plurality of light strings, each said light string including a plurality of lamp sockets and at least a pair of electrical wires, one of said pair of wires of each said light string being in electrical communication with each of said plurality of lamp sockets of said light string adjacent to each said lamp socket thereof; and (B) fastener means for connecting an adjacent pair of said light strings together intermediate an adjacent pair of said lamp sockets in each light string;

the improvement comprising:

(i) said pair of wires in each said light string being twisted together for movement as a unit intermediate said lamp sockets of said light string; and (ii) a third wire in each of said light strings save one being a bypass wire in each said light string extending directly from, and being in electrical communication with, the first of said plurality of lamp sockets of each said light string and the first of said plurality of light sockets of said next adjacent light string save one without physically or electrically contacting any other lamp sockets of said light string.

9. In a net light comprising:

(A) a plurality of light strings, each said light string including a plurality of lamp sockets and three electrical wires and defining intermediate portions intermediate adjacent pairs of said lamp sockets; said three electrical wires of each said light string including a first wire being live and in electrical communication with each of said plurality of lamp sockets of said light string adjacent to each said lamp socket thereof, a second wire being a return wire, and a third wire being a bypass wire; and (B) fastener means for connecting a pair of said intermediate portions of different light strings together intermediate adjacent pairs of said lamp sockets;

the improvement comprising:

(i) said first and second wires in each said light string being twisted together for movement as a unit intermediate said lamp sockets of said light string; and (ii) said third wire in each said light string extending directly from, and being in electrical communication with, the first of said plurality of lamp sockets of said light string and the first of said plurality of lamp sockets of said next adjacent light string without contacting any other lamp sockets of said light string.

10. In a net light comprising:

(A) at least one light string, said light string including a plurality of lamp sockets and at least a pair of electrical wires and defining intermediate portions intermediate adjacent pairs of said lamp sockets; one wire of said pair of wires being in electrical communication with said plurality of lamp sockets adjacent to said lamp sockets; and (B) fastener means for connecting a pair of said intermediate portions together intermediate said lamp sockets;

the improvement comprising (i) said pair of wires being twisted together intermediate said lamp sockets; and (ii) each said lamp socket defining means to assist in orienting the axis of said lamp socket generally parallel to said twisted pair of wires and in maintaining said twisted pair of wires neatly associated with said lamp socket without blocking viewing of a bulb in said lamp socket and without limiting flexibility of said intermediate portions.

11. The net light of claim 10 wherein said pair of wires are twisted together for movement as a unit.

12. The net light of claim 10 wherein said one wire is in electrical communication with each of said plurality of lamp sockets of said light string adjacent to each said lamp socket thereof, and the other of said pair of wires is a return wire.

* * * * *